US008029029B2

(12) United States Patent
Terhaar et al.

(10) Patent No.: US 8,029,029 B2
(45) Date of Patent: Oct. 4, 2011

(54) ROTARY LATCH WITH JOYSTICK

(75) Inventors: David Lee Terhaar, Allegan, MI (US); David Jay Terhaar, Holland, MI (US)

(73) Assignee: PI Optima, Inc., Holland, MI (US)

( * ) Notice: Subject to any disclaimer, the term of this patent is extended or adjusted under 35 U.S.C. 154(b) by 950 days.

(21) Appl. No.: 11/650,736

(22) Filed: Jan. 8, 2007

(65) Prior Publication Data

US 2007/0170728 A1 Jul. 26, 2007

Related U.S. Application Data

(60) Provisional application No. 60/756,847, filed on Jan. 6, 2006.

(51) Int. Cl.
*E05C 3/06* (2006.01)

(52) U.S. Cl. ..... 292/216; 292/DIG. 29

(58) Field of Classification Search ..... 292/216, 292/DIG. 29, 121, DIG. 37, DIG. 43, DIG. 42, 292/52, 219, 226, 228, 200, 202, 203, 210, 292/304; 262/100.04, 100.07
See application file for complete search history.

(56) References Cited

U.S. PATENT DOCUMENTS

| | | | | |
|---|---|---|---|---|
| 4,320,642 | A | 3/1982 | Pastva, Jr. | |
| 4,703,961 | A | 11/1987 | Weinerman et al. | |
| 4,911,487 | A | 3/1990 | Rachocki | |
| 4,917,412 | A | 4/1990 | Swan et al. | |
| 6,427,500 | B1 | 8/2002 | Weinerman et al. | |
| 6,471,260 | B1 | 10/2002 | Weinerman et al. | |
| 6,695,362 | B2 | 2/2004 | Klueting et al. | |
| 6,698,805 | B2 | 3/2004 | Erices et al. | |
| 7,234,329 | B2 * | 6/2007 | Mazolf et al. | 70/277 |
| 2005/0206172 | A1 * | 9/2005 | Bacon | 292/216 |

* cited by examiner

*Primary Examiner* — Kristina Fulton
(74) *Attorney, Agent, or Firm* — Clark Hill PLC

(57) ABSTRACT

A rotary latch for selectively locking a closure, such as a tonneau cover, is provided with a joystick or toggle release lever. The joystick release lever enables the rotary latch to be installed in any position with respect to a remote handle because the joystick can be pulled in any direction, 360 degrees, to release the rotary latch. The joystick includes a trapped base supporting a spherical portion that is nested in a circular opening in the housing of the latch. The joystick is spring loaded, and is movable about its central axis in any direction, causing the base to pivot against the inside of the housing. The base of the joystick is positioned over a spring-loaded catch locking the rotary latch. As the base of the joystick rotates against the inside of the housing, it depresses the spring-loaded catch, releasing the rotary latch.

40 Claims, 9 Drawing Sheets

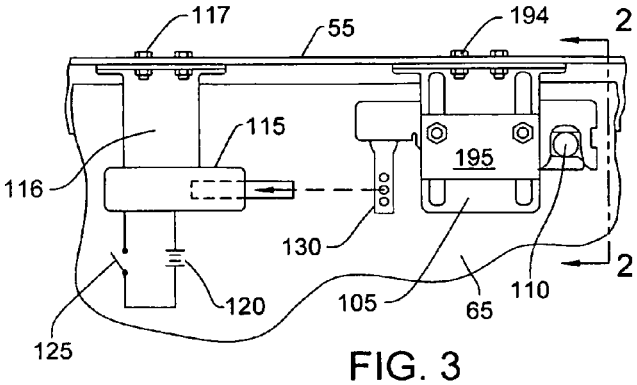
FIG. 3
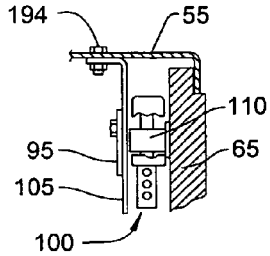
FIG. 2
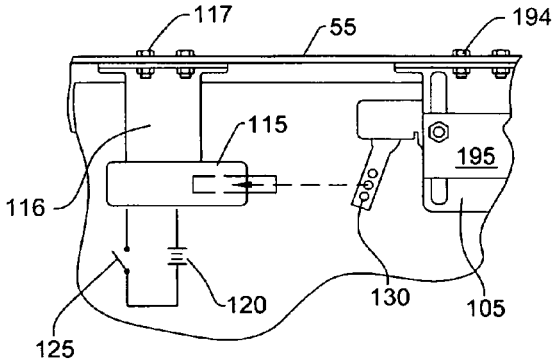
FIG. 3C
FIG. 3A
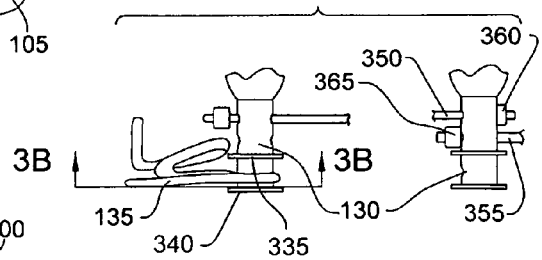
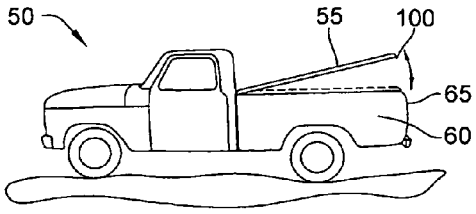
FIG. 1
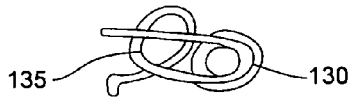
FIG. 3B

ROTARY LATCH WITH JOYSTICK

CROSS-REFERENCE TO RELATED APPLICATIONS

This application claims the benefit of U.S. Provisional Application Ser. No. 60/756,847, filed Jan. 6, 2006, which is incorporated herein in its entirety.

BACKGROUND OF THE INVENTION

1. Field of the Invention

The invention relates to a rotary latch.

2. Description of Related Art

Rotary latches are well known in the art, providing a strong, compact latching mechanism for many applications. A rotary latch generally includes a housing portion fixed to a first structure having a U-shaped slot configured to receive a post fixed to an opposing structure. A C-shaped latch is pivotally attached within the housing and arranged to rotate from a latched position within and perpendicular to the U-shaped slot to an unlatched position. In the latched position, the C-shaped latch and the U-shaped notch overlap to define a central opening configured to hold the post. In the unlatched position, the C-shaped latch is rotated toward the opening of the U-shaped slot, allowing the post to move into or out of the U-shaped slot. The C-shaped latch usually includes a catch on its body in an opposing position to the opening of the "C" relative to the pivot point of the latch. The catch is configured to act in concert with a trip lever pivotally mounted within the housing. The C-shaped latch and the trip lever are generally spring-biased. The C-shaped latch is biased in an open position and the trip lever is biased in a locked position. When the C-shaped latch is moved into the closed position, the trip lever is biased to engage the catch, holding the C-shaped latch in the closed position. The C-shaped latch is released by rotating the trip lever until it disengages from the catch. A stud is usually mounted to the trip lever for attachment of a release cable. Because of the configuration of the trip lever having a fixed pivot axle, it is necessary to arrange the release cable in a very narrow approach angle to the stud, in order to be able to pivot the trip lever with a minimal force exerted on and by the release cable. In the known arrangement, the release cable is generally aligned parallel to the housing of the rotary latch. Deviations from the optimal attachment of the release cable to the stud, with a tangential positioning of the cable relative to the pivot axis of the trip lever, unnecessarily increase the force required to release the rotary latch. The mechanical advantage available in the trip lever can therefore be lost by suboptimal positioning of the cable. Also, in different applications, it becomes necessary to modify the configuration of the trip lever and the stud so that the release cable can even access the stud. This necessitates the manufacture and stocking of multiple configurations of rotary latch assemblies, dependent upon the variety of applications used in a particular assembly.

It would be advantageous to provide a rotary latch system that provides the maximum available mechanical advantage regardless of the exact alignment of the release cable relative to the pivot axis of the trip lever. It would further be advantageous to provide a rotary latch system that improves the accessibility of a release mechanism in different applications without requiring the physical modification of the rotary latch.

BRIEF SUMMARY OF THE INVENTION

A rotary latch for selectively locking a closure, such as a tonneau cover on a pickup truck bed or the swing-up window on a pickup truck cap, is provided with a spring loaded toggle release lever, or joystick. The joystick enables the rotary latch to be installed in any position with respect to a remote actuating handle because the joystick can be pushed or pulled in almost any direction to release the rotary latch.

BRIEF DESCRIPTION OF THE SEVERAL VIEWS OF THE DRAWINGS

The present invention will become more fully understood from the following detailed description and the accompanying drawings, wherein:

FIG. 1 is a side view of a pickup truck with a tonneau cover and a rotary latch with joystick according to the invention.

FIG. 2 is a partially broken sectional view of the rotary latch according to the invention, mounted on FIG. 1 pickup truck tailgate and tonneau cover, and substantially as taken on the line 2-2 of FIG. 3.

FIG. 3 is a front view of the rotary latch of FIG. 2.

FIG. 3A shows various means for actuating connection to the joystick of FIG. 3 and schematically illustrates the possibility of linking two (or more) latch mechanisms by means of their joysticks.

FIG. 3B shows a power actuator to joystick connector according to FIG. 3.

FIG. 3C shows an unlatched position of parts of the FIG. 3 apparatus.

DETAILED DESCRIPTION OF THE INVENTION

Figure 4:
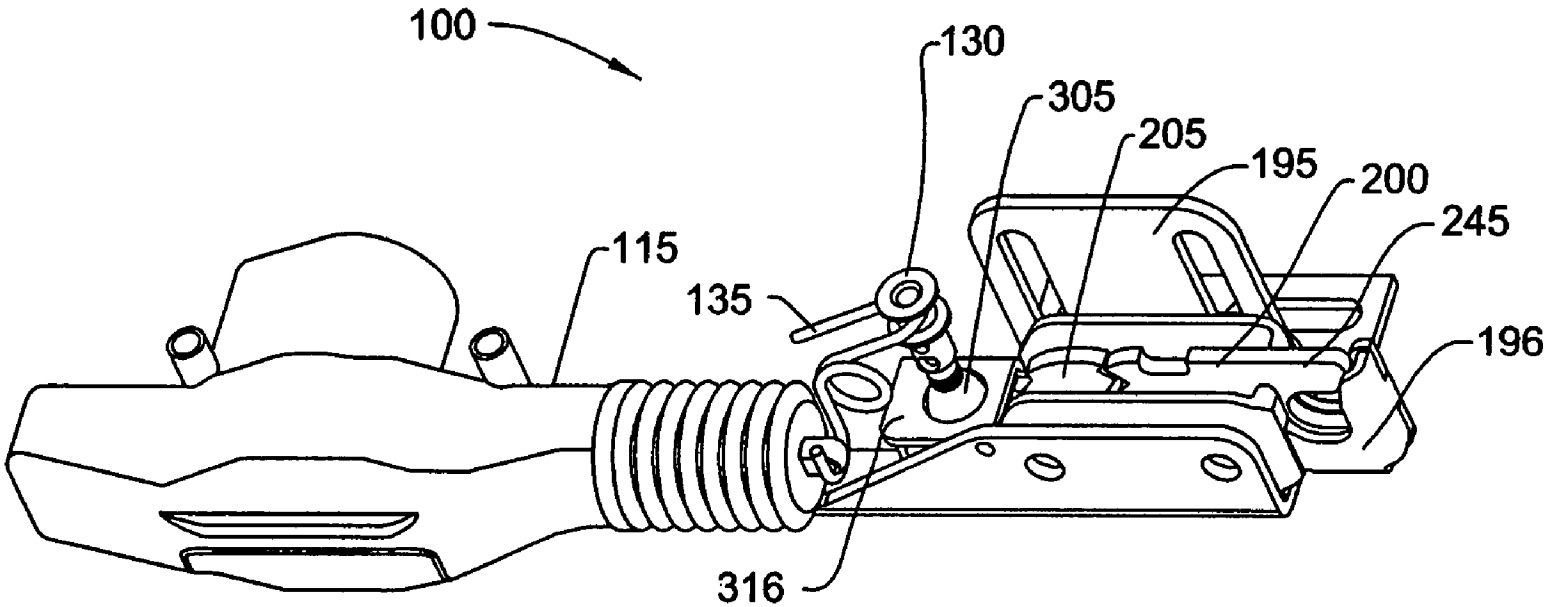
FIG. 4 is a pictorial view of the rotary latch of FIG. 3.
Figure 12:
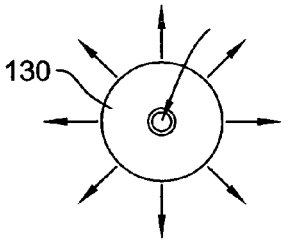
FIG. 12 is an end view of the free end of the joystick of the rotary latch of FIG. 3.
Figure 6B:
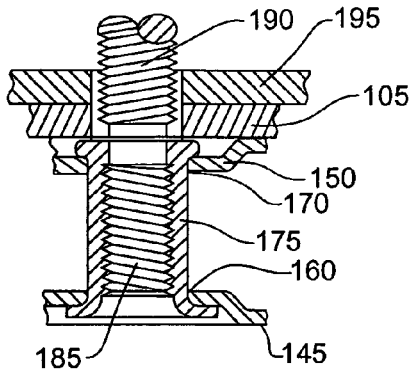
FIG. 6B is a sectional view substantially taken on the line 6B-6B of FIG. 6.
Figure 6:
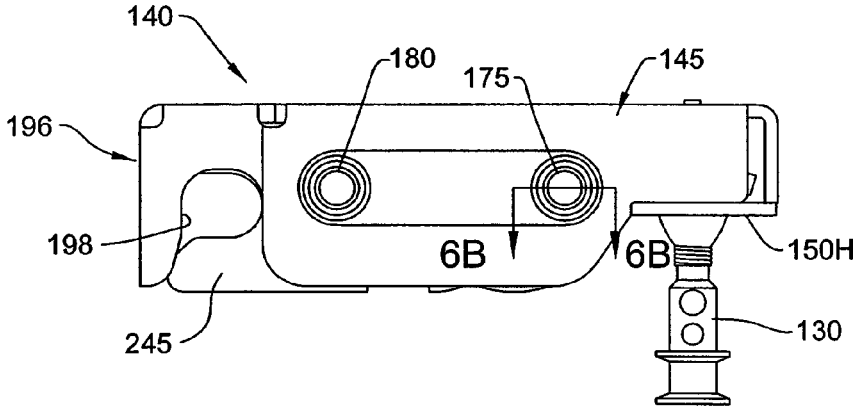
FIG. 6 is a rear view of the rotary latch of FIG. 3.

Certain terminology will be used in the following description for convenience in reference only and will not be limiting. The words "up", "down", "right" and left" will designate directions in the drawings to which reference is made. The words "in" and "out" will refer to directions toward and away from, respectively, the geometric center of the device and designated parts thereof. The words "proximal" and "distal" will refer to the orientation of an element with respect to the device. Such terminology will include derivatives and words of similar import.

FIG. 1 shows an application by way of example and not limitation, for the present invention. The invention is applicable in any enclosure requiring selective latching, and wherein the release of said latching can be accomplished by powered or manual actuation, electronically or mechanically, or by direct or remote control. In a motor vehicle 50, e.g. a pickup truck, the present invention is applied for latching a door on a pickup truck cap or, as here shown, a tonneau cover 55 over a pickup truck bed cargo area 60 having a tailgate 65. The tonneau cover 55 is movable between an open position (shown) and a closed position (shown in phantom). In the closed position, the tonneau cover 55 can be secured by a latch mechanism 100 releasably engaging a pin, or strike, 110 (FIG. 2). The latch mechanism 100 is here indicated as being mounted on the tonneau cover 55 and the pin 110 on the tailgate 65, respectively, but could on the tailgate 65 and tonneau cover 55, respectively instead.

The latch mechanism 100 is attached to the inside of the tonneau cover 55 by a bracket 105. A cooperating pin 110 is mounted to the tailgate 65.

Referring further to FIGS. 3A-3C, the latch mechanism 100 includes a joystick 130. The joystick 130 is spring biased into a rest position (vertical as shown in the drawings), and as will be further disclosed, displacement of the joystick 130 from such vertical position triggers unlatching of the latch mechanism 100.

Referring now to FIGS. 5-10, the latch mechanism 100 has a housing 140 formed of a left (in FIGS. 7-9) housing portion 145 and a right housing portion 150.

The left (FIG. 9) housing portion 145 comprises an elongate longitudinally extending sidewall 145A having a laterally and endwardly facing notch 145B, an elongate longitudinal flange 145C extending widthwise perpendicularly from and following one length edge of the sidewall, a perpendicular first end flange 145D at the notched end of the sidewall and adjacent one end of the elongate flange 145C, a narrow step-like end wall 145E extending widthwise perpendicularly from the other end of the sidewall to about half the width of the adjacent end of the elongate flange 145C, an extension wall 145F extending longitudinally from the free edge of the end wall 145E in a plane parallel to the sidewall 145A, and a narrow end flange 145G extending from the free end of the extension wall generally parallel to and spaced from the step-like end wall 145E.

The housing portion 150 is preferably substantially a mirror image of the housing portion 145 except as follows. The housing portion 150 comprises a longitudinally and widthwise extending flange 150H at the longitudinally extending edge 150J of its notch 150B, but omits parts comparable to the longitudinal flange 145C, first end flange 145D and narrow end flange 145G of the housing portion 145.

The left and right housing portions are joined by a pair of swaged bushings 175, 180 whose ends are fixedly received in respective apertures 155, 165 and 160, 170 in recessed portions of the sidewalls 145A and 150A. The swaged bushings 175, 180 each have a threaded interior passage 185 for receiving a threaded fastener (e.g. screw) 190, for securing the latch mechanism 100 to the bracket 105 and to an alignment plate 195. In FIG. 3, the bracket 105 is fixed to the tonneau cover 55 by bolt and nut units 194. The left (in FIGS. 5, 6 and 10-11) end of housing 140 defines a U-shaped channel, or notch, 198 for receiving the pin 110.

The housing narrow end walls 145E and 150E space the housing extension walls 145F and 150F laterally inboard of the housing sidewalls 145A and 150A, at the width of the end flange 145G. The extension walls 145F and 150F and end flange 145G define the left (in FIGS. 5 and 6) end portion of the housing as a narrow (compared to the width of the housing at the sidewalls 145 and 150) nose 196. The narrowed nose 196 allows mounting of the housing very close (e.g. almost abutting as in FIG. 5) the structure 65 (e.g. the truck tailgate) carrying the cooperating conventional pin 110, even if the latter incorporates a radially projecting mounting flange, or the like, as indicated in the dotted line at 111 in FIG. 5. Moreover, and as will be noted in FIG. 5, since the narrowed nose 196 is spaced laterally inboard from both sidewalls 145A and 150A of the housing 140, the housing 140 can be placed close to the pin supporting structure 65, even with its orientation reversed, e.g. with its sidewall 150A adjacent the pin supporting structure 65, rather than its sidewall 145A as in FIG. 5. Thus, not only can the latch mechanism 100 be mounted in any desired orientation (e.g. joystick up, joystick down, joystick left, joystick right, housing length axis vertical or horizontal or sloped, but in any of those orientations, the housing 140 can be placed close to or spaced from the pin support structure 65 with which the latch mechanism 100 latchingly cooperates.

The mounting bracket 105 here includes a main body and a mounting flange 106 perpendicular thereto. Slots 107 and 108 in the main of the bracket 105 and in the flange 106, respectively, allow adjustment of the location of the bracket 105 with respect to the adjacent side of the housing 140 and structure (e.g. the tonneau cover 55 of FIG. 1) on which the bracket is fixed.

Figure 8:
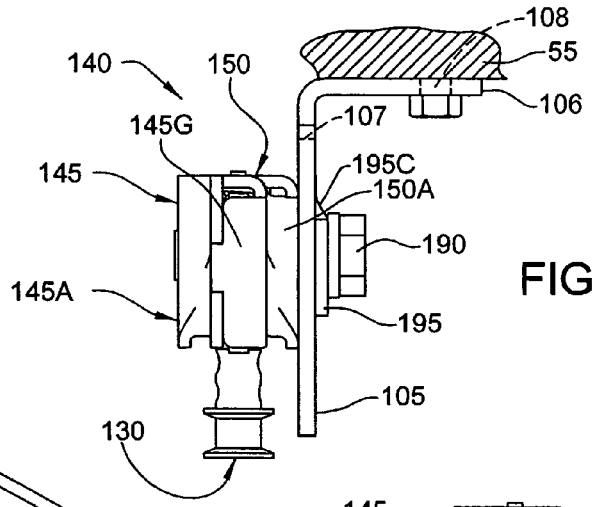
FIG. 8 is an opposite end view of the rotary latch of FIG. 3.

To allow mounting of the housing 140, in its contents, in any desired orientation, the bracket 105 may be fixed on either side of the housing 140, e.g. either adjacent to the sidewall 150A as seen in FIG. 8, or to the opposite side wall 145A. Moreover, with the mounting bracket 105 fixed to supporting structure (e.g. the FIG. 1 tonneau cover 55) by means of its mounting flange 106 (FIG. 8), the housing 140 can be fixed in its joystick down orientation of FIG. 8 or reoriented with the joystick 130 up.

Figure 8A:
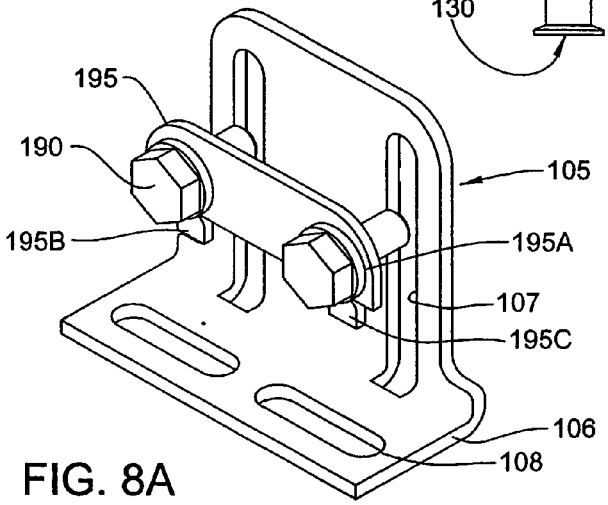
FIG. 8A is an exploded pictorial of a bracket for mounting the latch mechanism of FIGS. 1-8.
Figure 7:
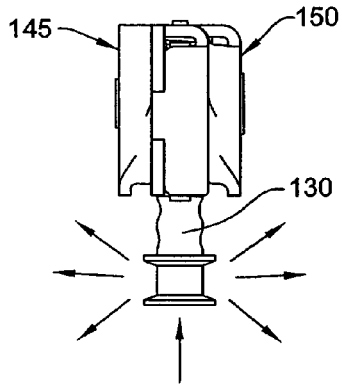
FIG. 7 is an end view of the rotary latch of FIG. 3.

The alignment plate 195 (FIG. 8A) has through holes 195A spaced from each other widthwise of the plate 195 at the same spacing as the slots 107 and the bracket and bushing holes 155 and 160 in the housing portion 145 and holes 165 and 170 in the housing portion 150 so as to coaxially align therewith. Aligned with the holes 195A are a pair of upper lugs 195B and a pair of lower lugs 195C adjacent the top and bottom (in FIG. 8A) edges of the alignment plate 195. The lugs 195B and 195C protrude toward and are of width be snuggly received in the bracket slots 107, as indicated in FIG. 8. With the screws 190 loosened to adjust the position of the housing 140 along the length of the slots 107, the adjustment plate 195 positively prevents one of the screws 195 from rising above the other and so prevents tilting of the housing 140 in a plane parallel to the adjustment plate 195 and main portion of the bracket 105, i.e. maintains the top and bottom plates of the housing 140 perpendicular to the length axis of the slots 107 of the bracket 105.

Figure 9:
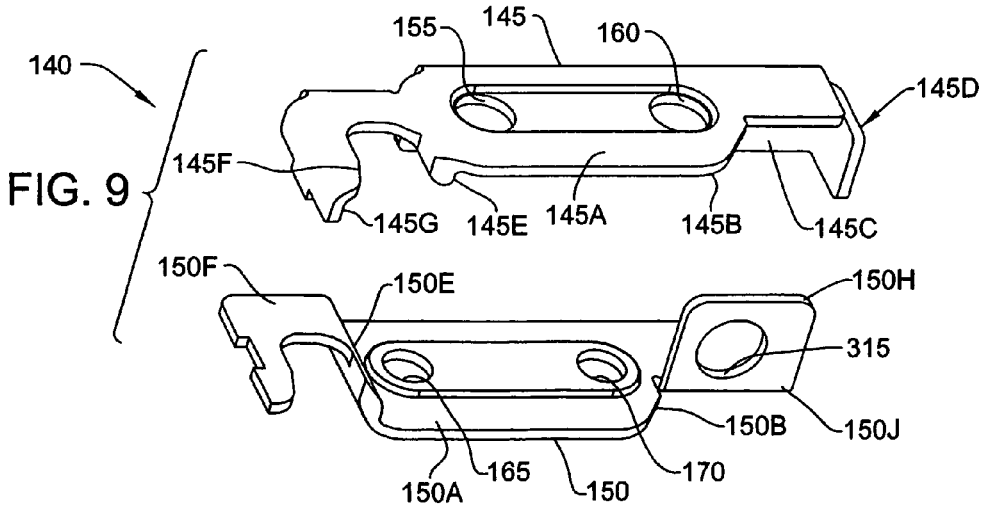
FIG. 9 is an exploded pictorial view of the housing of the rotary latch of FIG. 3.
Figure 9A:
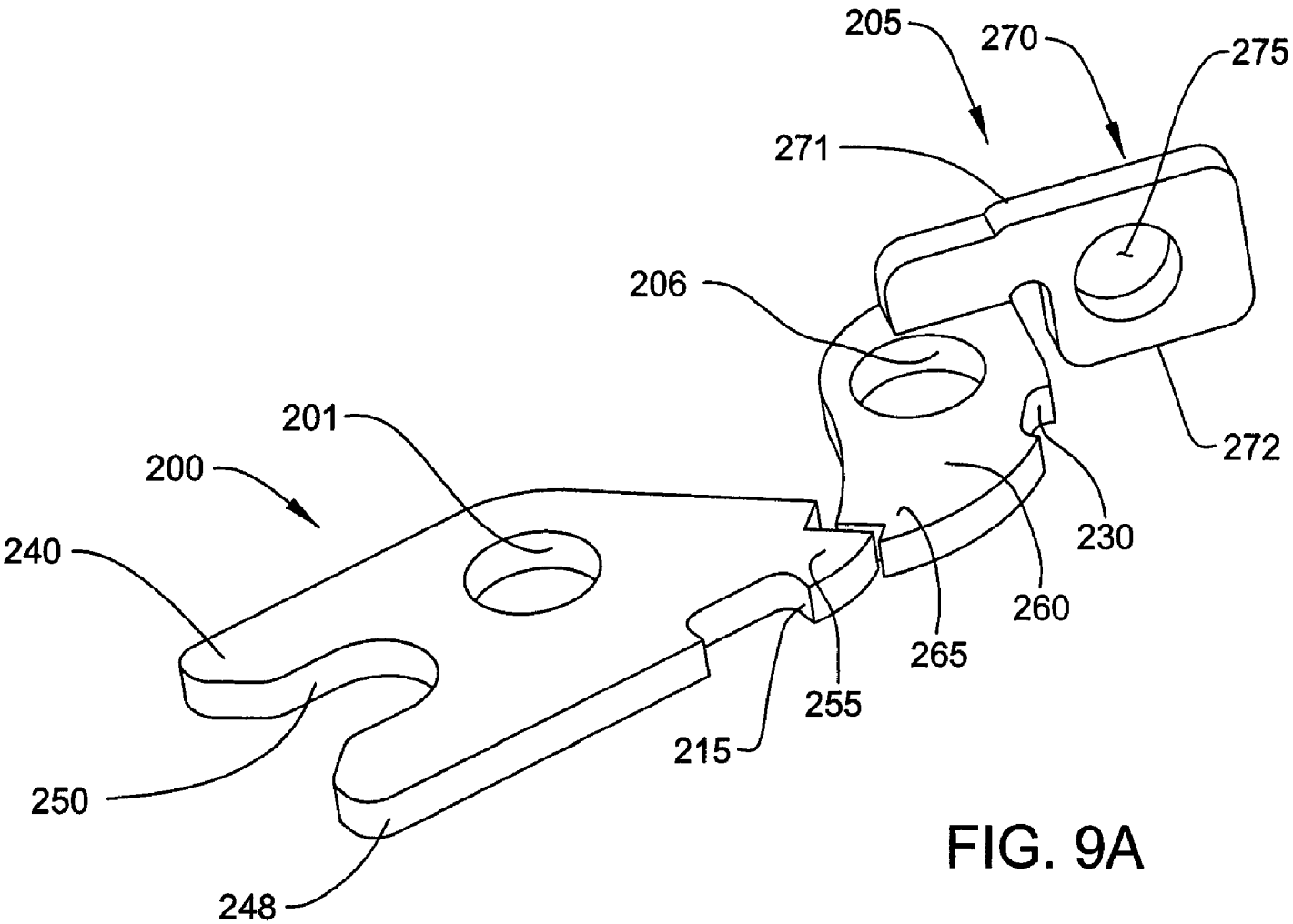
FIG. 9A is a pictorial view of the latch member and latch release member of the rotary latch of FIG. 3.

The latch mechanism 100 (FIGS. 9A and 10) includes a rotating latch member 200 and a rotating latch release member 205.

Figure 10:
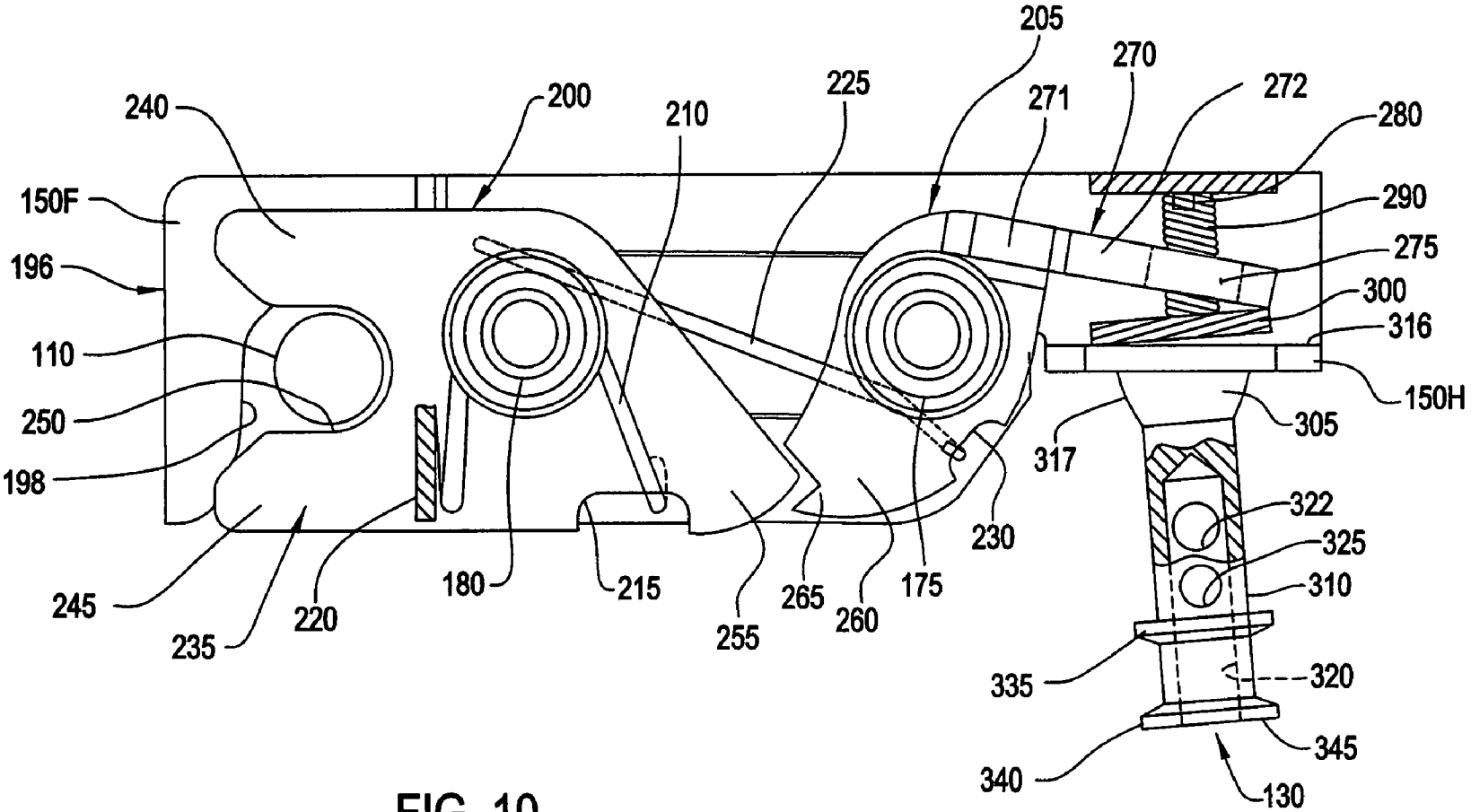
FIG. 10 is a side view similar to FIG. 6, but with the rear housing portion mostly removed.

As shown in FIG. 10, the latch member 200 and latch release member 205 are plate-like and pivotally mounted on the bushings 180 and 175, respectively, which extend through corresponding holes 201 and 206 (FIG. 9A) therein.

The latch member 200 includes a C-shaped portion 235 to the left (in FIG. 10) of the bushing 180 and a tail portion 255 on the opposite side of the bushing 180. The C-shaped portion 235 includes an inner arm 240 and an outer arm 245. The inner arm 240 and the outer arm 245 define a U-shaped channel, or notch, 250 therebetween. The tail portion 255 has a shallow notch 215 in its lower (FIG. 10) edge.

Figure 5:
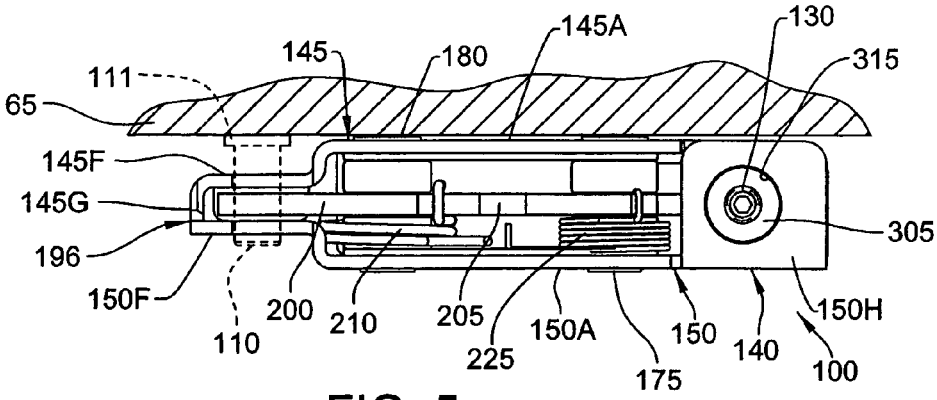
FIG. 5 is a bottom view of the rotary latch of FIG. 3.

The close flanking of the C-shaped portion 235 (FIG. 10) of the latch member 200 by the extension walls 145F and 150F of the housing portions 145 and 150 helps prevent the C-shaped portion 235 from bending or cocking out of its intended operating plane. Further, the bearing of the end flange 145G on the extension wall 150F (as seen in FIG. 5) helps rigidify the housing nose 196.

The latch release member 205 includes a catch portion 260. The catch portion 260 includes a step-like catch 265 and a shallow notch 230. The catch 265, as shown in FIGS. 9A-11, is configured to engage the tail portion 255 of the latch member 200. The latch release member 205 further includes a lever portion 270. The lever portion 270 and catch portion 260 are on opposite sides of the bushing 180. The lever portion 270 is formed as a flange perpendicular to the remainder of the latch release member 205 and comprises a leg 271 extending substantially tangentially beyond the bushing and terminating in a foot 272 extending parallel to the axis of the bushing hole 206. The foot 272 here includes an aperture 275.

A torsion-type latch spring 210 is also concentrically mounted on the bushing 180, and at one end engages the notch 215 in the latch member 200. The spring 210 at its other end bears against the end wall 220 of the housing 140, thereby biasing the latch member 200 in a counterclockwise direction (as seen in FIG. 10). A second torsion-type spring 225 is mounted concentrically on the bushing 175. The second spring 225 at one end engages the notch 230 in the latch release member 205. The second spring 225 has its other end trapped behind the bushing 180 to bias the latch release 205 in a clockwise direction.

Figure 6A:
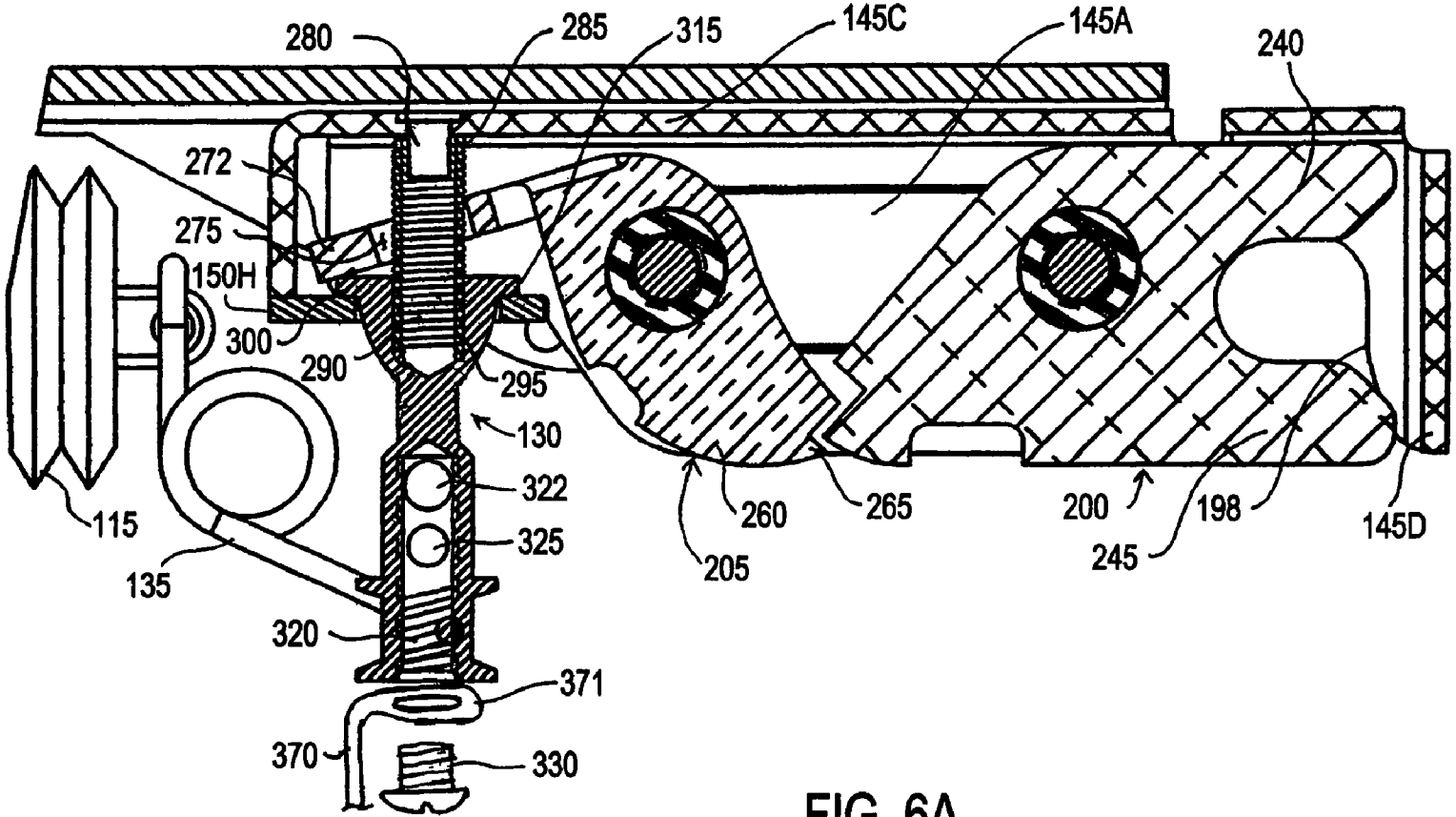
FIG. 6A is a fragment of FIG. 3 showing the joystick in central cross section.

As shown in FIG. 6A, a rivet 280 protrudes through the longitudinal flange 145C in alignment with the aperture 275 and thus secures a first end 285 of a coil compression spring 290. The compression spring 290 passes through the aperture 275 and is received within a cavity 295 in the joystick 130.

The joystick 130 includes a flat circular base portion, or annular flange, 300 (FIG. 10), a necked-down (here convex or substantially frusto-conical) central portion 305, and an elongate cylindrical arm portion 310. The joystick 130 (FIGS. 6A, 9 and 10) passes through a round aperture 315 in the flange 150H of the right housing portion 150. The flat circular base portion 300 of the joystick 130 is larger than the aperture 315, so that the joystick 130 is retained within the housing 140, with the base portion 300 bearing against an inner surface 316 of the flange 150H of the housing 140. The joystick 130 is biased into the aperture 315 by the compression spring 290 bearing between the base portion 300 of the joystick 130 and the longitudinal flange 145C of the left housing portion 145. The joystick central portion 305 tapers, from a diameter closely conforming to the aperture 315, to the diameter of the cylindrical arm portion 310. The profile of the outer wall 317 of the tapered central portion 305 can be linear or arcuate.

The compression spring 290 is partially compressed between the longitudinal flange 145C (FIG. 6A) and the inboard end of the recess, or cavity, 295 in the inboard end of the joystick 130, even in the relaxed (unactuated) position of the joystick shown. The rivet 280 is received in the first end 285 of the spring 290 to prevent the spring 290 from sliding sideways along the flange 145C. The function of the rivet 280 can also be provided by forcible upsetting of the material of the flange 145C in a position to retain the first end 285 of the spring 290.

The joystick cylindrical arm portion 310 is hollow, having a threaded internal recess 320. A pair of openings 322, 325 pass transversely through the cylindrical arm portion 310 and the internal recess 320. The threaded internal recess 320 is configured for receiving a connecting screw 330 (FIG. 6A). The cylindrical arm portion 310 further includes a pair of longitudinally spaced annular flanges 335, 340 adjacent at its distal end 345.

A given latch mechanism 100 may be used with one or more devices for unlatching same. As shown for example in FIG. 3, the latch mechanism 100 is operable by a conventional power actuator 115. As shown, the power actuator 115 is mounted in line with the latch mechanism 100 by a bracket 116 fixed to the tonneau cover 55 by nut and bolt units 117 (or by a bracket not shown carried by the latch mechanism 100). The power actuator 115 conventionally is electrically connected to a power source 120 (e.g. the vehicle battery not shown) and operated by a switch 125. The switch 125 is conventionally capable of direct manual actuation or actuation by a conventional wireless remote control (not shown). The joystick 130 is connected to the power actuator 115 by a substantially rigid spring wire, push/pull connector, or "spring pull", 135 (FIG. 4). Due to the construction of the joystick 130, displacement of the joystick 130 in any direction will actuate the latch mechanism 100. Therefore, the joystick 130 need not be aligned with the latch mechanism 100 as shown. The power actuator 115 can be any type of mechanical or electrical actuator, or a hydraulic, magnetic, or pneumatic actuator. Furthermore, the actuator 115 need not be fixedly attached to the joystick 130, but need only be positioned so as to displace the joystick 130 upon activation.

As shown in FIG. 3A, the spring pull 135 grips the cylindrical arm portion 310 of the joystick 130 between the flanges 335, 340. As a further example one or more conventional pullable release cables 350, 355 (FIG. 3A) can be received through the openings 322, 325, and maintained therein by distal end plugs 360, 365 fixed thereon. As a further example, a similar release cable, or a push rod 370, having an eye 371 (FIG. 6A) can be fixed to the joystick 130 by a screw 330.

In some instances, it may be desirable to provide more than one latch mechanism in a single installation of (e.g. tonneau cover pickup truck bed as in FIG. 1). For example, two could be located and spaced apart along the tailgate, or one might be provided on each side of the pickup truck bed. In such a dual installation, it may be desired to use a single powered or manual actuator to unlatch both latch mechanisms 100. This can be done without any modification to the joysticks 130 of the dual latch mechanisms 100. As seen for example in FIG. 3A, two joysticks 130 are spaced apart and linked by the cable 350,) the left (in FIG. 3A) joystick 130 being connected through the wire member 135 to the power actuator 115 (FIG. 3), and the other joystick being connected by a further cable 355 to another (e.g. manual) actuator of conventional type, not shown. In this way, actuation of one joystick 130 actuates the other so that both of the corresponding latch mechanisms 100 unlatch simultaneously.

Since axial pushing on the exposed end of the at rest joystick will also pivot the latch release member 205 and open the latch mechanism 100, it is contemplated that screw 330 (FIG. 6A) may in some instances be substituted by a manually engageable push button, not shown, with the latch mechanism 100 being located so that such push button is reachable by a user either inside or outside the protected cavity (e.g. truck bed in FIG. 1).

Operation

The latch mechanism 100 has a latched position (FIGS. 3 and 10), e.g. for latching the tonneau cover 55 in its closed, dotted line position on the pickup truck 50.

As shown in FIG. 10, the latch member 200 is held in a latched position against the bias of the spring 210 by the interference of the latch release member 205, wherein the tail portion 255 of the latch member 200 is received within the catch 265 of the latch release member 205.

Figure 11B:
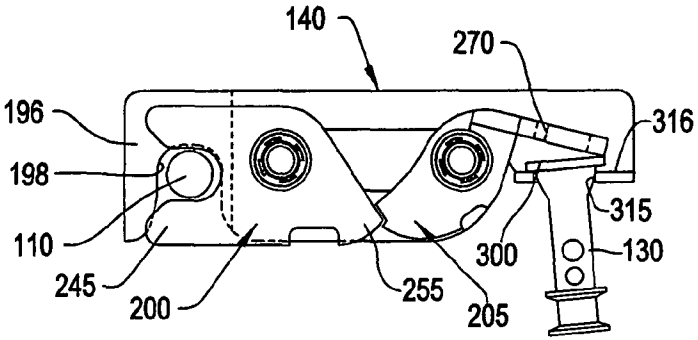
FIGS. 11A-11H depict the release sequence the main parts (only) of the rotary latch of FIG. 3.
Figure 11A:
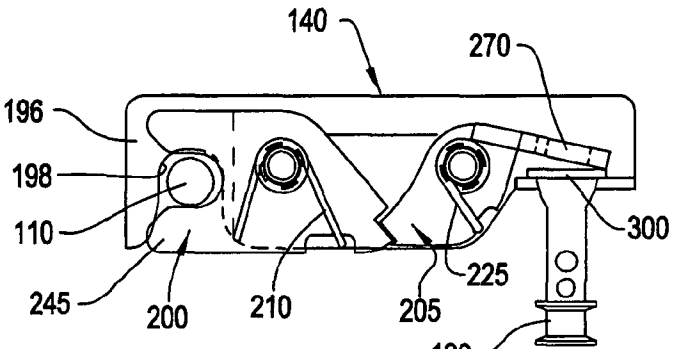

Referring sequentially to FIGS. 11A-11H, the latched latch mechanism 100 is unlatched by axially depressing or pivotally deflecting the joystick 130 from its rest (here vertical) position shown in FIG. 11A. In this position, the latch member 200 is positioned such that the outer arm 245 of the C-shaped portion 235 appears perpendicular to the left end 196 of the housing 140. The latch member 200 and the housing 140 thereby close the channel 198 and trap the pin 110 therein, such that the tonneaus cover (for example) is closed and latched.

The joystick 130 is then pivotally deflected e.g. by the power actuator 115 drawing on the spring pull 135, by a manual actuator (not shown) pulling on a cable 350, 355, or in any other convenient way.

In FIG. 11B, the joystick 130 has been slightly pivotally deflected (to the right in FIG. 11B, though to the left or into or out of the page, or even axial deflection upward into the housing 140 would serve as well), forceably rotating the latch release member 205 slightly counterclockwise without yet releasing the latch member 200. The joystick flat circular base portion 300 is slightly tilted away from the inner surface 316 of the housing 140, while the frusto-conical portion 305 of the joystick 130 rides in the aperture 315 in the housing 140.

Figure 11F:
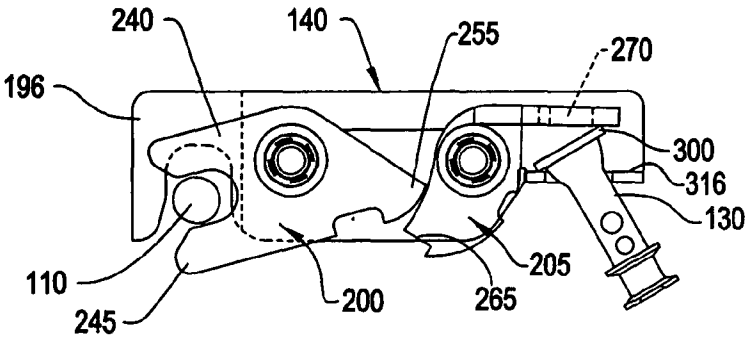
Figure 11E:
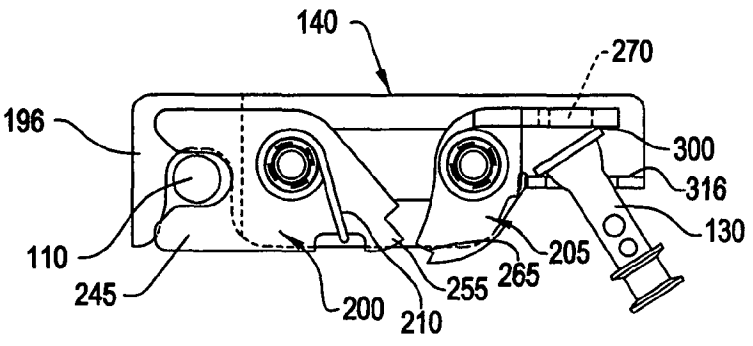
Figure 11D:
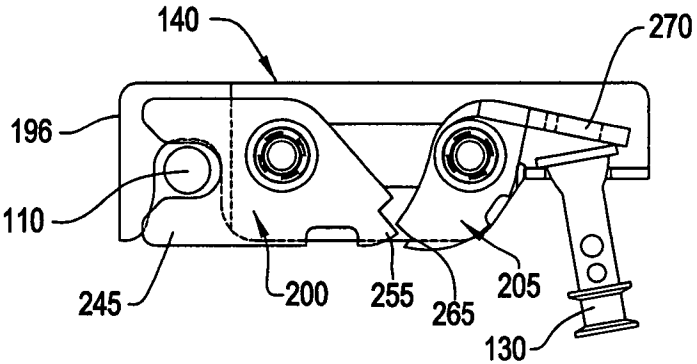
Figure 11C:
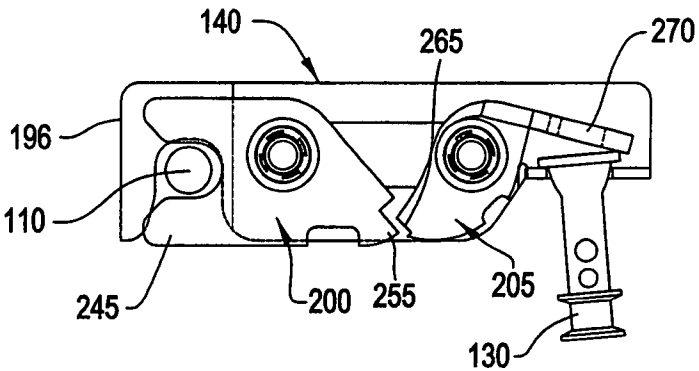

In FIGS. 11C-11D, the joystick 130 is further deflected. The latch release member 205 is rotated further counterclockwise still without releasing the latch member 200.

In FIG. 11E, the joystick 130 is fully deflected so that the latch release member 205 has been rotated sufficiently counterclockwise to clear the tail portion 255 of the latch member 200. The latch member 200 is now free to rotate counterclockwise under the biasing force of the spring 210.

Figure 11H:
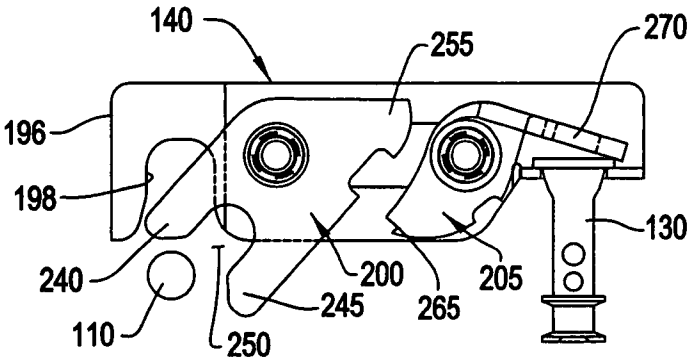
Figure 11G:
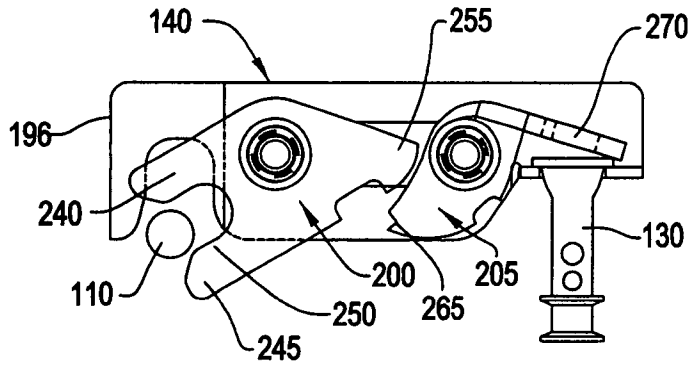

In FIGS. 11F-11H, the latch member 200, freed from latch release member 205, sequentially rotates counterclockwise towards its unlatched position. In FIG. 11H, the latch member 200 has rotated to its fully counterclockwise, fully open position. At any time in the FIG. 11F-11H sequence the joystick 130 can be released, so that the latch release member 205 is allowed to rotate clockwise under the bias of the spring 225, to return both to their FIG. 11A rest position. As the latch member 200 rotates counterclockwise under the bias of its spring 210, the inner arm 240 of latch member 200 effectively pushes the latch mechanism 100 and pin 110 away from each other. The user is thus free to open the tonneau cover 55 to its FIG. 1 solid line position.

In the preferred embodiment shown, and as seen for example in FIG. 10, during actuation the joystick base portion 300 bears at diametrically opposed points on the housing flange 150H and on the foot 272 of the latch release member 205 to define a driven lever arm. On the other hand, the free end of the joystick, as at a point between the flanges 335 and 340, may be connected to an actuator (for example the power actuator 115 or one of the release cables 350, 355, or the like). The distance, between that connection point on the free end of the joystick and the mentioned point on the joystick base 300 bearing on the housing flange 150H, defines a driving lever arm. The ratio of these two lever arms (e.g. 2 to 1) defines the mechanical advantage provided by the joystick.

Similarly, the distances from the rotative center of the latch release lever 205 (the axis of swaged bushing 175) to the point of contact of the foot 272 with the joystick base 300 above mentioned and to the point of engagement of the step-like catch 265 with the portion 255 of the latch member 200, define corresponding driving and driven lever arms of the latch release member 205. For example in the embodiment shown, the ratio of such lever arms is approximately 2 to 1, the latch release member 205 thus providing a mechanical advantage of approximately 2 to 1.

Thus, the joystick and catch release member, taken together would, in this example, thus provide a combined mechanical advantage of approximately 4 to 1.

Moreover, the distances from the pivot axis of the latch member 200 (the central axis of its swaged bushing 180) to the point of contact of its tail portion 255 with the step-like catch 265 of the latch release member 205 and to the point of contact of the spring 210 with the shallow notch 215, again defines driving and driven lever arms, which in the embodiment shown are the length ratio of about 3/2.

Thus, in this particular example, there is a total mechanical advantage of about 6 to 1 from the joystick free end to pin 110. The FIG. 1 tonneau cover 55 may have substantial weight. To release the latch mechanism 100 requires the tonneau cover mounted inner arm 240 to push downward on the pin 110 with sufficient force to cause the bushing 180 and housing 140 and bracket 105 to lift the tonneau cover 55 out of its normally closed, latched position shown in dotted line in FIG. 1. Thus, the latch member spring 210 has to be strong enough to forcibly pivot the latch lever 200, from its FIG. 11F position through its FIG. 11G position and into its fully opened FIG. 11H position, to lift the heavy tonneau cover 55. However, that same strong spring 210, in the latch mechanism closed position of FIGS. 10 and 11A strongly holds the tail portion 255 against the step-like catch 265, so as to strongly resist the opening rotation of the latch release lever 205 above discussed as to FIGS. 11B-11D. Again, the distance, from the point of contact of the tail portion 255 of the latch member 200 with the step-like catch 265 of the latch release member 205, (FIGS. 10 and 11A) to the point of contact of the spring 210 with the edge of the spring 210 with the edge of the notch 215 in the latch member 200, is here in the approximate ratio of 1 to 1. Accordingly, the combined mechanical advantage available to overcome the force of the spring 210 by actuation of the joystick 130 is hereabout 6 to 1. Accordingly, if a 40 pound force is required to lift the tonneau cover 55 to complete the laterally sequence from FIG. 11F through 11H, only about ⅙ that force (e.g. 7 pounds) need be applied to the end of the free end of the joystick 130 to open the latch mechanism 100. Accordingly, it becomes possible to actuate the joystick 130 by relatively low force means, for example a conventional low cost power actuator 115, even with a relatively heavy tonneau cover, and without need for the user to attempt to assist the unlatching process by manually lifting the tonneau cover. In short, even a relatively heavy tonneau cover 55 will pop open as the end result of the unlatching process shown in the FIG. 11A-11H sequence.

Vehicle users will occasionally load their pickup beds high enough that the user must exert downward pressure on the tonneau cover 55 to enable the pin 110 and latch lever 200 to assume their FIG. 10 latched positions. In that instance, after latching, the user stops pressing downward on the tonneau cover 55 and moves away to other activity, but the overweight load in the pickup bed is still pressing the tonneau cover upward away from the pickup truck bed, and hence urges the latch mechanism 100 upward with respect to the pin 110, i.e. adding to the counterclockwise (in FIG. 10) force of the spring 210 and hence pushing the tail portion 255 even harder against the step-like catch 265 to further resist counterclockwise, unlatching rotation of the latch release member 205. Thus, the substantial mechanical advantage provided by the inventive joystick 130 and latch release 205 allows this added resistance to latching to be overcome with a relatively light force applied to the joystick 130 manually, by cables, or by the power actuator 115.

The power actuator 115 and other means (e.g. cables 350/365 of FIG. 3B actuate the joystick independently of each other, i.e. the power actuator actuates the joystick when the cables are slack and the cables actuate the joystick when the actuator is not powered. The latch mechanism 100 can be initially installed without the power actuator and, at some later time, the user can add a power actuator.

Should a person accidentally become trapped in the FIG. 1 pickup truck bed with the tonneau cover 55 latch closed, the inventive latch mechanism 100 provides a safety advantage in that it enables relatively easy escape. More particularly, the joystick 130 stands proud from the housing 140 to a substantial extent and so is relatively easy to find, even in the dark. Also, the joystick 130 requires only a very low activating force (in view of the substantial mechanical advantage of the latch mechanism 100), and pushing or pulling the joystick in a wide range of directions causes the latch mechanism 100 to unlatch.

The joystick 130 is free to rotate about its length (vertical in FIGS. 6 and 6A) axis to orient the diametral through holes 322 and 325 in any desired direction on a plane perpendicular to the longitudinal axis of the joystick, so as to accommodate the actuators (e.g. cables 350 and/or 355 (FIG. 3B)) approaching the joystick from virtually any direction.

While the invention has been described in the specification and illustrated in the drawings with reference to preferred embodiments, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to particular embodiments illustrated by the drawings and described in the specification as the best mode presently contemplated for carrying out this invention, but that the invention will include any embodiments falling within the scope of the appended claims.

What is claimed is:

1. A rotary latch mechanism, fixable on a first structure for releasably latching same to a second structure comprising:

a housing having a first housing wall;

a first biasing member;

a latch member pivotally mounted on said housing between a latching position and an unlatching position, and being resiliently biased towards said unlatching position by said first biasing member;

a latch release member pivotally mounted on said housing between a holding position and a releasing position, said latch release member in said holding position engaging said latch member and holding said latch member in said latching position, said latch release member being resiliently biased by a second biasing member toward said holding position, said latch release member in said releasing position being disengaged from said latch member and releasing same from said latching position; and a movable member having a base portion and an elongated arm portion extending therefrom and having a length axis, said base portion engaging said housing and further engaging said latch release member, said movable member having (1) a non-actuated at-rest position corresponding to said holding position of said latch release member, and (2) a first actuated position angularly displaced from said at-rest position and (3) a second actuated position displaced from said at-rest position and said first actuated position, said movable member in either of said actuated positions holding said latch release member in said releasing position, said first housing wall having a hole therethrough, said movable member having an intermediate portion protruding snugly but tiltably through said hole, said arm portion comprising an elongate arm extending from said intermediate portion, said base portion and intermediate portion and arm being substantially coaxial, said base portion comprising a flange extending radially beyond said intermediate portion, said flange having an edge portion bearing on said latch release member and an inner face of said housing.

2. The apparatus of claim 1 in which said movable member is mounted swivelably on said housing.

3. The apparatus of claim 2 and further comprising a third biasing member interposed between said housing and said base portion of said movable member, said third biasing member comprising an elongated bendable resilient element having a first end seated on said housing opposite said base portion of said movable member and a second end seated on said base portion of said movable member, said third biasing member being disposed in said housing, said elongated bendable resilient element having a substantially straight condition corresponding to said at-rest position of said movable member and having a bent condition corresponding to at least one of said first and second actuated positions of said movable member.

4. The apparatus of claim 3, wherein said base portion of said movable member has a recess opening toward said latch release member, said elongate bendable resilient element having a mid-portion extending past an end portion of said latch release member, said first end of said elongate bendable resilient element being fixed against at least radial movement with respect to said housing, said second end of said elongate bendable resilient element being snugly received in said recess.

5. The apparatus of claim 3 in which said third biasing member comprises a coil spring at least laterally fixed on said housing and on said base portion of said movable member, said housing having a protrusion opposing said base portion of said movable member and resides partially within a first end of said coil spring, said base portion of said movable member having a recess receiving a second end of said coil spring.

6. The apparatus of claim 3 in which said base portion of said movable member is trapped between said latch release member and said first wall of said housing, said latch release member and said resilient element resiliently biasing said base portion to lie against said first housing wall in said at-rest position.

7. The apparatus of claim 6 in which said intermediate portion is substantially frusto-conical.

8. The apparatus of claim 6 in which said intermediate portion is convexly rounded.

9. The apparatus of claim 6 in which said resilient element extends from substantially fixed relation with said base portion of said movable member, through a hole in a portion of said latch release member, to at least laterally fixed engagement with a second housing wall spaced opposite said first housing wall.

10. The apparatus of claim 1, wherein said second actuated position is angularly displaced from said rest position and said first actuated position, and wherein said movable member has a third actuated position pushed axially inward with respect to said housing and from said rest position.

11. The apparatus of claim 1, wherein said rest position and said first and second actuated positions are noncoplanar.

12. The apparatus of claim 1, wherein said movable member has a free end, said free end having a path of motion defining an orbit around said rest position of said movable member.

13. The apparatus of claim 1, wherein said arm portion has a radially facing connection point, said movable member being rotatable on said axis to face said connection point in circumferentially spaced directions for connection to a remote release cable, without limitation as to the orientation of said cable.

14. The apparatus of claim 1, further comprising a mounting system fixed with respect to the housing including a first plate having at least one slot, a second plate having at least one protrusion extending into the slot, and a fastener engaging the first and second plates, wherein the fastener passes through the slot in the first plate.

15. The apparatus of claim 14, the first plate further comprising at least one pair of parallel slots and the second plate further comprising at least one pair of protrusions extending into the pair of parallel slots, and further comprising a pair of fasteners extending through the first and second plates and through the pair of parallel slots.

16. The apparatus of claim 1, wherein said movable member and latch release member and latch member have a combined mechanical advantage of about 6 to 1.

17. The apparatus of claim 1, further comprising a power actuator mounted with respect to said housing and displaceably engaging the arm portion.

18. The apparatus of claim 1 in combination with a closure member for a motor vehicle having a cargo area, said closure member being pivotally mounted relative to the motor vehicle and having an open position and a closed position over the cargo area, said housing being attached to one of said motor vehicle and the closure member, and an engageable element attached on the other of said motor vehicle and the closure member and engaged by said latch member in said closed position of said closure member.

19. The apparatus of claim 18, further comprising a second rotary latch mechanism having a second arm portion connected in series with the first mentioned said rotary latch mechanism by a release cable joining the first mentioned said arm portion to said second arm portion.

20. A rotary latch mechanism, fixable on a first structure for releasably latching same to a second structure, comprising:

a housing;

a first biasing member;

a latch member pivoted on an axis on said housing and having pivotally spaced latching and unlatching positions, and being resiliently biased toward said unlatching position by said first biasing member, said latch member having a second structure engaging portion, said latch member having a tail portion and a spring engaged portion spaced from said latch member pivot axis at a first distance ratio;

a latch release member pivoted on an axis on said housing, and having pivotally spaced latch member holding and latch member releasing positions, and being resiliently biased by a second biasing member toward said holding position, said latch release member having a latch member engaging portion and a foot spaced from said latch release member pivot axis at a second distance ratio;

an elongated member having a base portion and an arm portion extending axially therefrom, said base portion having laterally spaced points respectively pivotally bearing on said housing and latch release member foot, said arm portion having an actuable free end such that the elongated member is omnidirectionally tiltable and when said member is tilted in any direction said base portion moves said latch release member, said arm portion free end and said point of said base portion bearing on said latch release member foot being spaced from said point of said base portion bearing on said housing at a third distance ratio, the multiplied first, second, and third distance ratios being about 6:1.

21. The apparatus of claim 20, wherein said latch release member foot extends from the remainder of said latch release member in a plane substantially perpendicular to that of said remainder, said latch member and latch release member remainder being substantially planar and mutually coplanar and substantially perpendicular to the respective pivot axes.

22. The apparatus of claim 20 including bushings pivotally supporting said latch member and latch release member on said housing, a first spring on said latch member bushing and having ends respectively bearing on an end wall of said housing and on a notched portion of said latch release member, a second spring on said latch release member bushing and having ends respectively bearing on said latch member bushing and on a notched portion of said latch release member.

23. The apparatus of claim 22, wherein said housing has spaced side walls flanking said latch release member and a portion of said latch member, said housing further having a narrowed nose extending beyond said side walls and comprising extension walls spaced inboard from the planes of said side walls and flanking said second structure engaging portion of said latch member.

24. A rotary latch mechanism, fixable on a first structure for releasably latching same to a second structure comprising:

a housing;

a first biasing member;

a latch member pivotally mounted on said housing between a latching position and an unlatching position, and being resiliently biased towards said unlatching position by said first biasing member;

a latch release member pivotally mounted on said housing between a latch member holding position and a latch member releasing position, said latch release member in said holding position engaging said latch member and holding said latch member in said latching position, said latch release member being resiliently biased by a second biasing member toward said holding position, said latch release member in said releasing position being disengaged from said latch member and releasing same from said latching position;

a movable member pivotally engaging said housing and further engaging said latch release member and having a longitudinal axis, said movable member having a non-actuated at-rest position corresponding to said holding position of said latch release member, and a first actuated position, displaced from said at-rest position, at which an extension of said movable member longitudinal axis crosses an extension of said longitudinal axis of the movable member in the at-rest position, said movable member in said actuated position holding said latch release member in its releasing position; and a power actuator having a substantially rigid actuation member, said actuation member positioned adjacent said movable member when said movable member is in the non-actuated at-rest position, said actuation member disposed to contact said movable member and tiltably displace the movable member to the first actuated position;

wherein said housing has a wider portion and a narrower nose extending therefrom, and said latch member has a second structure engaging portion which extends into said nose.

25. The apparatus of claim 24, wherein said housing wider portion comprises spaced parallel side walls, and said nose portion comprises parallel extension walls set inboard of the planes of said side walls.

26. The apparatus of claim 25, wherein said extension walls have U-shaped cutaways flanking and aligned laterally with a notch in a C-shaped part of said second structure engaging portion of said latch member, wherein said latch member, said latch release member and said movable member are arranged sequentially in said housing wider portion except for said latch member second structure engaging portion extending into said nose.

27. The apparatus of claim 25, wherein said side walls are connected by a longitudinal flange perpendicular thereto, a protrusion which extends inboard from said longitudinal flange, and a compression spring fixed to and extending between said protrusion and said movable member.

28. The apparatus of claim 24, wherein said latch member includes a C-shaped portion and a tail portion and a through hole about which said latch member pivots, and wherein said latch release member includes a lever portion and a catch portion and a through hole about which the latch release member pivots, wherein said latch member further comprises a first spring-receiving notch, whereby said latch member is biased toward said unlatching position by a first torsion spring coaxial with said latch member hole, engaging said first spring-receiving notch and said housing, and wherein said latch release member further comprises a second spring-receiving notch, whereby said latch release member is biased toward said releasing position by a second torsion spring coaxial with said latch release member hole, engaging said second spring-receiving notch and said housing.

29. The apparatus of claim 24, wherein said latch release member includes a main portion defining a plane and a foot extending therefrom in a plane substantially perpendicular to said main portion plane, said foot having an aperture therethrough, and a spring extending through said aperture between fixed points on said housing and elongate member and biasing said movable member to an at-rest position.

30. The apparatus of claim 24, further comprising a non-twist bracket mounting system including a slotted plate having a first structure fixable portion and at least one pair of parallel slots, a second plate having at least one pair of protrusions extending into corresponding ones of said slots and a pair of holes aligned with said slots, a pair of fasteners extending through said second plate holes and said slotted plate slots and into fixed engagement with said housing, said fasteners fixedly clamping said slotted plate in sandwiched relation between said second plate and housing, said housing having a plurality of selectable positions distributed along the length of said slots, including positions upright and inverted with respect to said first structure fixable portion of said slotted plate.

31. A rotary latch mechanism, fixable on a first structure for releasably latching same to a second structure comprising:

a housing;

a first biasing member;

a latch member pivotally mounted on said housing between a latching position and an unlatching position, and being resiliently biased towards said unlatching position by said first biasing member;

a latch release member pivotally mounted on said housing between a holding position and a releasing position, said latch release member in said holding position engaging said latch member and holding said latch member in said latching position, said latch release member being resiliently biased toward its holding position by a second biasing member, said latch release member in said releasing position being disengaged from said latch member and releasing same from said latching position; and a movable member having a base portion and an arm portion extending therefrom and having a length axis, said base portion pivotally engaging said housing and further engaging said latch release member, said movable member having (1) a non-actuated at-rest position corresponding to said holding position of said latch release member, and (2) a first actuated position angularly displaced from said at-rest position and (3) a second actuated position displaced from said at-rest position and said first actuated position;

said movable member in either of said actuated positions holding said latch release member in said releasing position, said base portion of said movable member being trapped between said latch release member and a first wall of said housing, said latch release member and a resilient element resiliently biasing said base portion to lie against said first housing wall in said at-rest position, said first housing wall having a hole therethrough, said movable member having a tapered intermediate portion protruding snugly but tiltably through said hole, said arm portion comprising an elongate arm extending from said tapered intermediate portion, said base portion and intermediate portion and arm being substantially coaxial, said base portion comprising a flange extending radially beyond said tapered intermediate portion, said flange having an edge portion bearing on said latch release member and an inner face of said housing.

32. The apparatus of claim 31 in which said tapered intermediate portion is substantially frusto-conical.

33. The apparatus of claim 31 in which said tapered intermediate portion is convexly rounded.

34. The apparatus of claim 31 in which said resilient member extends from substantially fixed relation with said base portion of said movable member, through a hole in a portion of said latch release member, to at least laterally fixed engagement with a second housing wall spaced opposite said first housing wall.

35. A rotary latch mechanism, fixable on a first structure for releasably latching same to a second structure comprising:

a housing having a first housing wall;

a latch member pivotally mounted on said housing at a first pivot axis wherein said latch member is pivotable between a latching position and an unlatching position, and resiliently biased towards said unlatching position by a first biasing member;

a latch release member pivotally mounted on said housing at a second pivot axis wherein said latch release member is pivotable between a holding position and a releasing position, said latch release member in said holding position engaging said latch member and holding said latch member in said latching position, said latch release member being resiliently biased by a second biasing member toward said holding position, said latch release member in said releasing position releasing said latch member from said latching position for biased pivoting to said unlatching position; and a movable member having a base portion and an elongated arm portion extending from said base portion which said arm portion defines a length axis, said base portion pivotally engaging said housing so as to be pivotable about a variable third pivot axis oriented transverse to said length axis, and said base portion further engaging said latch release member, said arm portion having an end portion which is displaceable in multiple directions to pivot said movable member about said variable third pivot axis between (1) a non-actuated at-rest position corresponding to said holding position of said latch release member wherein said length axis is in an at-rest first orientation, and (2) an actuated position angularly displaced from said at-rest position wherein said length axis is angularly displaced from said first orientation to a second orientation oriented at an acute angle relative to said first orientation, said first and second orientations of said length axis each being transverse to said variable third pivot axis, said end portion being displaceable in any one of said multiple directions to vary the orientation of said variable third pivot axis relative to said first pivot axis and said second pivot axis, and permit angular displacement of said length axis between said first and second orientations, said movable member in said actuated position holding said latch release member in said releasing position.

36. The apparatus of claim 35 wherein said first housing wall has a hole therethrough, and said movable member extending tiltably through said hole, said base portion comprising a flange extending radially into contact with said first housing wall wherein said flange has a first edge portion bearing on said latch release member and a second edge portion bearing on said first housing wall to define said variable third axis, a location of said second edge portion along said flange being variable depending upon said one of said multiple directions in which said edge portion is displaced to vary said orientation of said variable third axis.

37. The apparatus according to claim 35 further comprising a third biasing member normally biasing said movable member to said at-rest position.

38. The apparatus of claim 35 wherein said movable member has an axially-displaced position pushed axially inward with respect to said housing from said rest position.

39. The apparatus of claim 35 wherein said first and second pivot axes are in fixed, non-variable orientations, and said variable third pivot axis is variable between a parallel orientation and multiple transverse orientations relative to said first and second pivot axis to allow said movement of said end portion in said multiple directions.

40. The apparatus of claim 35 wherein said variable third pivot axis is defined by direct contacting engagement between said base portion of said movable member and said housing.

* * * * *

UNITED STATES PATENT AND TRADEMARK OFFICE

CERTIFICATE OF CORRECTION

PATENT NO. : 8,029,029 B2
APPLICATION NO. : 11/650736
DATED : October 4, 2011
INVENTOR(S) : David Lee Terhaar et al.

It is certified that error appears in the above-identified patent and that said Letters Patent is hereby corrected as shown below:

Column 8, Line 33 "of 1 to 1". should read -- of 1 ½ to 1. --

Signed and Sealed this
Thirteenth Day of November, 2012

David J. Kappos

David J. Kappos
*Director of the United States Patent and Trademark Office*